US010895423B2

(12) United States Patent
Weilharter

(10) Patent No.: US 10,895,423 B2
(45) Date of Patent: Jan. 19, 2021

(54) FIREARM

(71) Applicant: Rene Weilharter, Ybbs an der Donau (AT)

(72) Inventor: Rene Weilharter, Ybbs an der Donau (AT)

( * ) Notice: Subject to any disclaimer, the term of this patent is extended or adjusted under 35 U.S.C. 154(b) by 0 days.

(21) Appl. No.: 16/629,213

(22) PCT Filed: Aug. 7, 2018

(86) PCT No.: PCT/AT2018/060180
§ 371 (c)(1),
(2) Date: Jan. 7, 2020

(87) PCT Pub. No.: WO2019/028486
PCT Pub. Date: Feb. 14, 2019

(65) Prior Publication Data

US 2020/0200495 A1 Jun. 25, 2020

(30) Foreign Application Priority Data

Aug. 8, 2017 (AT) ..... A 50662/2017

(51) Int. Cl.
*F41A 3/56* (2006.01)
*F41A 3/38* (2006.01)

(52) U.S. Cl.
CPC . *F41A 3/38* (2013.01); *F41A 3/56* (2013.01)

(58) Field of Classification Search
CPC ..... F41A 3/36; F41A 3/38; F41A 3/50; F41A 3/52; F41A 3/56; F41A 5/12
USPC ..... 89/168, 162, 175, 176
See application file for complete search history.

(56) References Cited

U.S. PATENT DOCUMENTS 3,306,168 A 2/1967 Blumrick
3,408,895 A * 11/1968 Lopez ..... F41A 21/484 89/145
4,461,203 A * 7/1984 Jawdat ..... F41A 3/46 89/154
6,993,864 B1 * 2/2006 O'Clair ..... F41A 3/14 42/71.02

(Continued)

*Primary Examiner* — Jonathan C Weber
(74) *Attorney, Agent, or Firm* — Andrew Wilford

(57) ABSTRACT

The invention relates to a firearm comprising a housing (1) with a rigid barrel (2) arranged therein, a magazine that can be mounted in the receptacle of the housing (1) and provided with cartridges (4), a closure (3) that can be moved with respect to the housing (1) in the longitudinal direction of the barrel (2) and that is used to guide cartridges (4) from the magazine into a cartridge holder (5) or for ejecting empty cartridge cases. The closure (3) is mounted completely inside the housing (1) over its entire movement path. A sear frame (6) is coupled to the closure (3) which is tensioned by means of a closing spring (7) in the direction of the front closed position of the closure (3). The invention also relates to a locking block (8) coupled to the closure (3) when the closure is in the front closed position. The locking block (8) can be tensioned by a locking spring (9) in the direction of said position, and the locking block (8) can be moved when triggering a shot through the closure (3) by compressing the locking spring (9) only for one part of the movement path of the closure (3) until the decoupling position is reached together with the closure (3).

5 Claims, 3 Drawing Sheets

(56) References Cited

U.S. PATENT DOCUMENTS

| | | | | |
|---|---|---|---|---|
| 8,065,950 | B2 * | 11/2011 | Kaminsky | F41C 3/00 89/196 |
| 8,783,158 | B2 | 7/2014 | Kerbrat | |
| 9,546,831 | B2 * | 1/2017 | Bandini | F41A 3/44 |
| 10,203,173 | B2 * | 2/2019 | Ellis | F41A 5/02 |
| 2014/0196337 | A1 * | 7/2014 | Bandini | F41A 3/78 42/16 |
| 2018/0306536 | A1 * | 10/2018 | Ellis | F41A 3/44 |

* cited by examiner

FIREARM

CROSS REFERENCE TO RELATED APPLICATIONS

This application is the US-national stage of PCT application PCT/AT2018/060180 filed 7 Aug. 2018 and claiming the priority of Austrian patent application A50662/2017 itself filed 8 Aug. 2017.

TECHNICAL FIELD

The invention relates to a firearm comprising a receiver carrying a fixed barrel, a magazine with cartridges that can be inserted into a seat of the receiver, and a slide movable relative to the receiver in the longitudinal direction of the barrel in order to transfer cartridges from the magazine into a chamber in the receiver and to move cartridge casings from the chamber to an ejection port.

PRIOR ART

The most common action used today in self-loading firearms is the Browning system. To accomplish the self-loading process, gas pressure built up when a shot is fired is used to accelerate the slide to the rear and thereby eject the cartridge casing and reload a new cartridge from a magazine. The gas pressure when a shot is fired is initially very high and must be absorbed by appropriate mechanisms in the action before the remaining energy can be used for the movement of the slide. In the Browning system, the slide and the barrel are one subassembly when a shot is fired and are accelerated backward together by the gas pressure. The slide is usually embodied as a movable carriage atop the receiver. Together with the barrel, this subassembly consequently has a very high mass inertia so that it can effectively reduce the initially high gas pressure. After a first segment of motion during the returning of the barrel/slide subassembly, the barrel is pivoted downward toward the receiver as a result of appropriate control guides and/or connecting members and thereby decoupled from the slide, whereupon the slide continues rearward alone and carries out the reloading process.

One disadvantage of this model is that the barrel is not firmly seated in the receiver, which leads to reduced precision and greater susceptibility to malfunction. For this reason, numerous efforts have been devoted to the creation of a self-loading action that eliminates the above-described disadvantages and allows a self-loading firearm with a fixed barrel to be constructed. One example of such a system is the blowback action. In that system, the slide is formed by two masses that engage in the receiver by roller bearings. When a shot is fired, both masses of the slide are moved rearward, and the roller bearings are pressed inward from their respective seats in the receiver and drive the two masses of the slide apart. This results in unequal acceleration of the two masses of the slide, whereby the initially high gas pressure is likewise made available for driving the cartridge before the residual energy is used up for the movement of the slide and the reloading process. One disadvantage of this system is that the construction is very complicated and requires a great number of parts, which substantially increases the susceptibility to malfunction.

OBJECT OF THE INVENTION

It is the object of the present invention to provide a firearm having an action for a self-loading process that eliminates the above-described disadvantages of previous actions and can be manufactured inexpensively with few parts, thereby also reducing its susceptibility to malfunctions. At the same time, the firearm is to have a fixed barrel, and the action is to have such a compact construction that it can be implemented so as to fit completely inside the weapon, which provides advantages in terms of functional reliability, since contaminants from the outside are largely ruled out.

This object is achieved according to the invention in that the slide is supported inside the receiver over its entire movement path, and that a drive clip supported inside the receiver is coupled with the slide and is biased by a recoil spring toward a front closed position, and that a latch block supported inside the receiver is also coupled with the slide when the slide is in the front closed position, the latch block being biased by a latch spring toward this position, and, upon firing of a shot under compression of the latch spring, the latch block being displaceable together with and by the slide only for a portion of the movement path of the slide until a decoupled position is reached. In the closed, ready-to-fire position, the slide, latch block, and drive clip form a subassembly moved rearward when a shot is fired. The initially high gas pressure consequently acts against the applied spring force as well as against the masses of the three components, which keeps the breech closed long enough to fire the cartridge. The subassembly is then moved rearward until the latch block reaches the decoupled position. At this point the latch block is decoupled from the slide, and the slide and the drive clip alone continue moving rearward. In order to enable all of the parts to be accommodated inside the receiver, the slide, latch block, and drive clip must be made correspondingly small, which means that they have a low mass inertia. In order to ensure that adequate counterforces for the initially high gas pressure can be applied nonetheless, the spring forces are selected appropriately in order to compensate for the lack of mass inertia.

It is another advantageous feature that the latch spring has a higher spring constant than the recoil spring. The latch spring, together with the inertia of the latch block, must keep the breech closed long enough in the initial phase of the firing of a shot that the cartridge can exit the barrel. These parts are then intended to reduce the forces accordingly, so that the remaining energy from the decoupled position is sufficient for the reloading process, which reloading process is carried out by the slide, drive clip, and recoil spring.

According to another advantageous feature, the slide has lateral projections that extend normal to its direction of movement and engage with corresponding stop faces on the latch block on movement from the front closed position to the decoupled position, and vice versa. The latch block can, for example, have stop faces in the form of lateral hooks that hook onto the lateral projections on the slide and bias them toward the closed front position by the force of the latch spring. During the rearward movement, the latch block can, for example, be pivoted downward at the decoupled position, as a result of which the hooks disengage from the projections.

An advantageous embodiment of the invention is that the latch block has bearing pins that extend normal to the longitudinal direction of the barrel and are guided in slide tracks in the receiver, each of the slide tracks having a rear end portion that deviates from the direction of movement of the slide at an angle thus enabling the latch block to move into the decoupled position upon entry of the bearing pins into these end portions. Pivoting of the latch block into the decoupled position can thus be achieved very easily by an appropriate guide groove in the receiver. As will readily be understood by those with average skill in the art, the bolt can also be on the receiver and the slotted guide on the latch block depending on the design of the firearm.

It is also an advantageous feature of the present invention that the drive clip has securing projections that, on reaching the decoupled position, engage in corresponding recesses in the latch block during the rearward movement of the slide after a shot is fired and secure the latch block for the continuing movement path of the drive clip in the setting of the decoupled position. These securing projections can, for example, be embodied as ribs that extend in the longitudinal direction of the barrel and, once the decoupled position is reached, plunge into corresponding longitudinal grooves in the latch block as soon as the drive clip travels further to the rear. The drive clip thus secures the latch block in this pivoted-out position until it passes the decoupled position on the way back toward the front closed position and releases the latch block again. The latch block then pivots up again and engages with the stop faces on the projections on the slide and thus pulls it back into the closed front position with the aid of the latch spring.

Finally, it is another advantageous feature that the recoil spring is supported between a bearing portion of the drive clip and a bearing portion of the latch block. As a result, the latch spring alone is compressed in the first segment of motion between the front closed position and the decoupled position, and the recoil spring is compressed only once the decoupled position is reached. Depending on the application, the spring forces can thus be defined very precisely in every position of the motion sequence.

BRIEF DESCRIPTION OF THE DRAWINGS

The invention will now be described in greater detail with reference to an embodiment and the accompanying drawings, wherein.

MANNER(S) OF CARRYING OUT THE INVENTION

Figure 1:
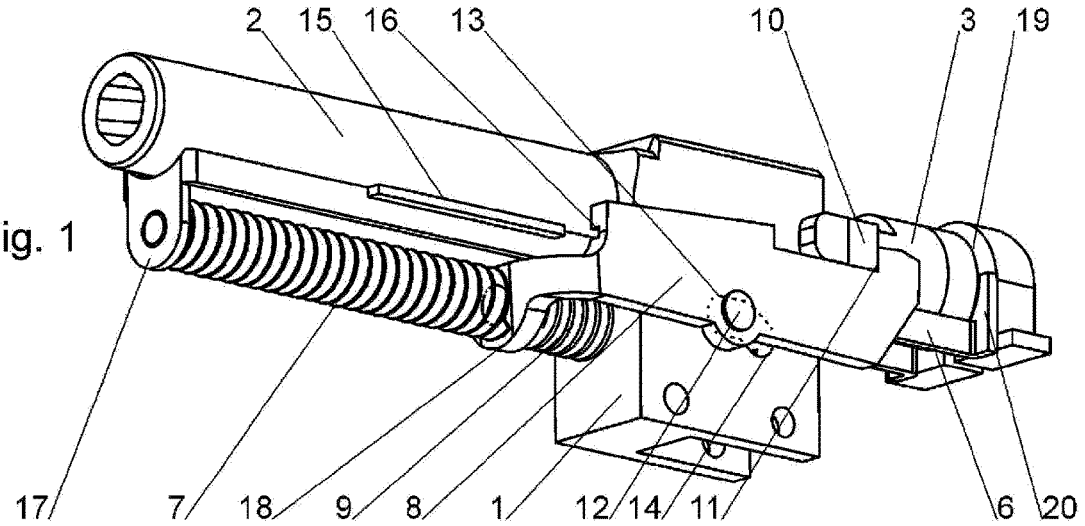
FIG. 1 is a schematic perspective view of the essential components of the invention with the receiver largely not shown, FIGS. 2 to 6 each schematically show the main components of the present invention in the different positions along the movement path of the slide.

FIG. 1 shows only the essential main components of one possible embodiment of a firearm according to the invention. Only a portion of the multipart receiver 1 is shown on which the parts of the latch system are mounted, the receiver as a whole having additional parts, such as the grip with magazine well, an upper cover, etc. The chamber 5 (see FIG. 7) extended forward by the rigidly mounted barrel 2 is in the upper illustrated part of the receiver portion. The slide 3 shown here in the front closed position behind the chamber 5 can move inside the receiver 1 in the longitudinal direction of the barrel 2. Grooves 19 into which wings 20 of the drive clip 6 engage are at the rear end of the slide. The drive clip 6 also extends longitudinally of the barrel 2 to a front bearing portion 17, against which the recoil spring 7 is braced.

Furthermore, a latch block 8 is inside the receiver 1 and mounted in the receiver by lateral bearing pins 12 in respective slide tracks 13. A bearing portion 18 is located at the front end of the latch block 8, and a latch spring 9 is braced between the receiver 1 and the bearing portion 18. On the other hand, the recoil spring 7 is supported between the bearing portion 17 of the drive clip 6 and the bearing portion 18 of the latch block 8. Abutment surfaces 11 are present at the rear end of the latch block 8 in the form of upwardly open hooks that cooperate with corresponding lateral projections 10 on the slide 3 and bias it toward the front closed position.

Figure 2:
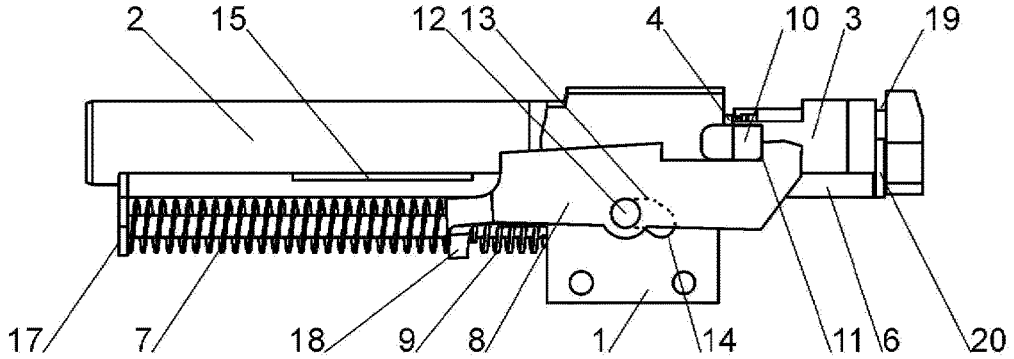
Figure 3:
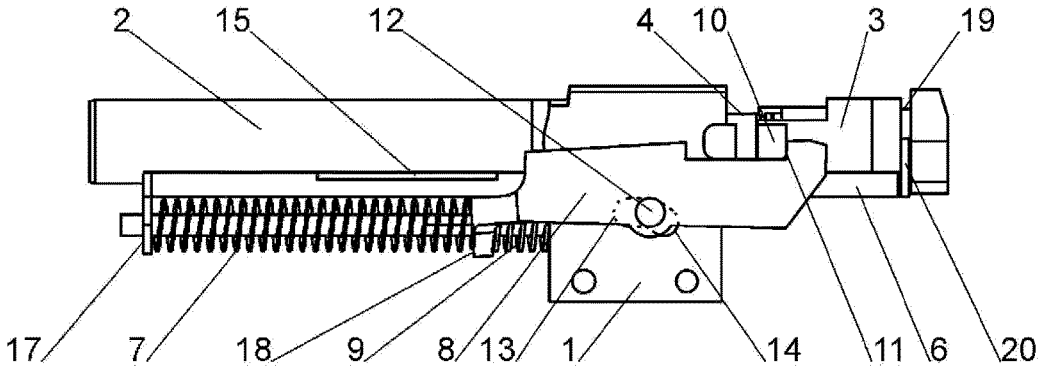
Figure 4:
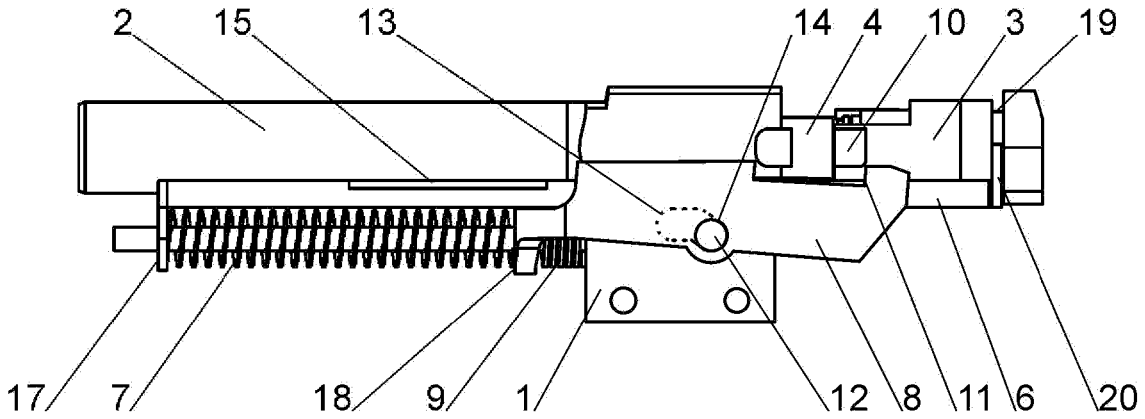
Figure 5:
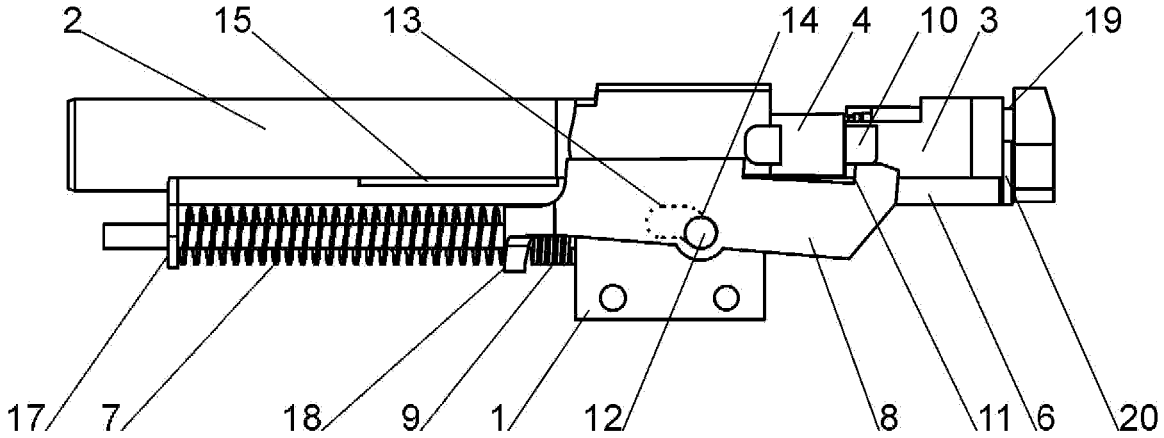

FIG. 2 shows the illustration of FIG. 1 in a side view in the locked front position. When a shot is fired, the entire subassembly consisting of the slide 3, drive clip 6, and latch block 8 is first moved rearward by the gas pressure while compressing the latch spring 9 (see FIG. 3). After a short distance, the bearing pins 12 of the latch block 8 enter the rear end portions 14 of the slide tracks 13 in the receiver 1. These end portions are inclined downward at an angle and thus pivot the latch block 8 downward into a decoupled position (see FIG. 4). As a result, the stop faces 11 disengage from the lateral projections 10 of the slide 3, and the slide 3 together with the drive clip 6 now move further rearward while only compressing the recoil spring 7 (see FIG. 5).

During this rearward movement, lateral securing projections 15, here in the form of lateral ribs on both sides of the drive clip 6, slide into corresponding grooves 16 (see FIG. 1) on the latch block 8 and thereby hold the latch block 8 in the downwardly pivoted-out decoupled position.

Figure 6:
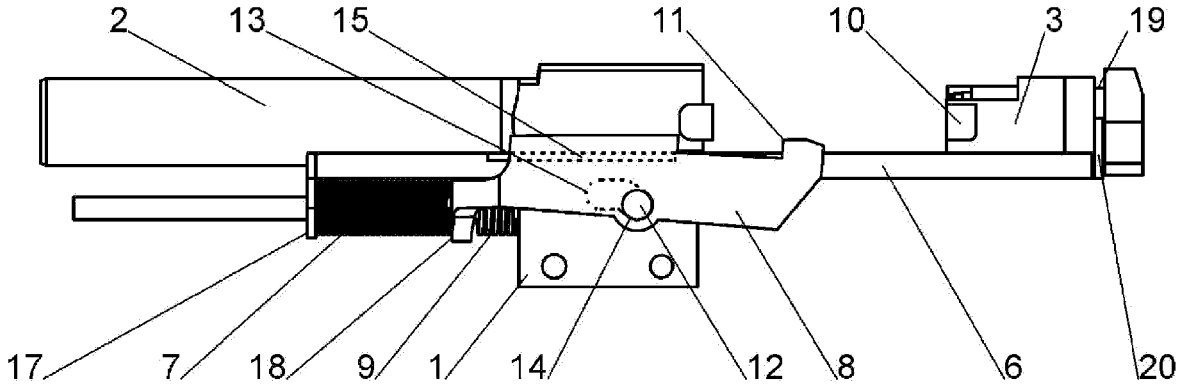

After reaching the rearmost end position (see FIG. 6), the slide 3 is moved forward again by the recoil spring 7 acting on the driving bracket 6, a new cartridge 4 also being taken out of the magazine by the slide. After the slide 3 and drive clip 6 have passed the decoupled position of the latch block 8, the securing projections 15 emerge again from the corresponding recesses 16 on the latch block 8 and release it. Due to the force of the latch spring 9, this is now forced forward and upward along the slide tracks 13, engages with its stop faces 11 on the lateral projections 10 on the slide 3, and pulls the slide 3 back into the front closed position, whereby the position according to FIG. 1 is reached again.

Figure 7:
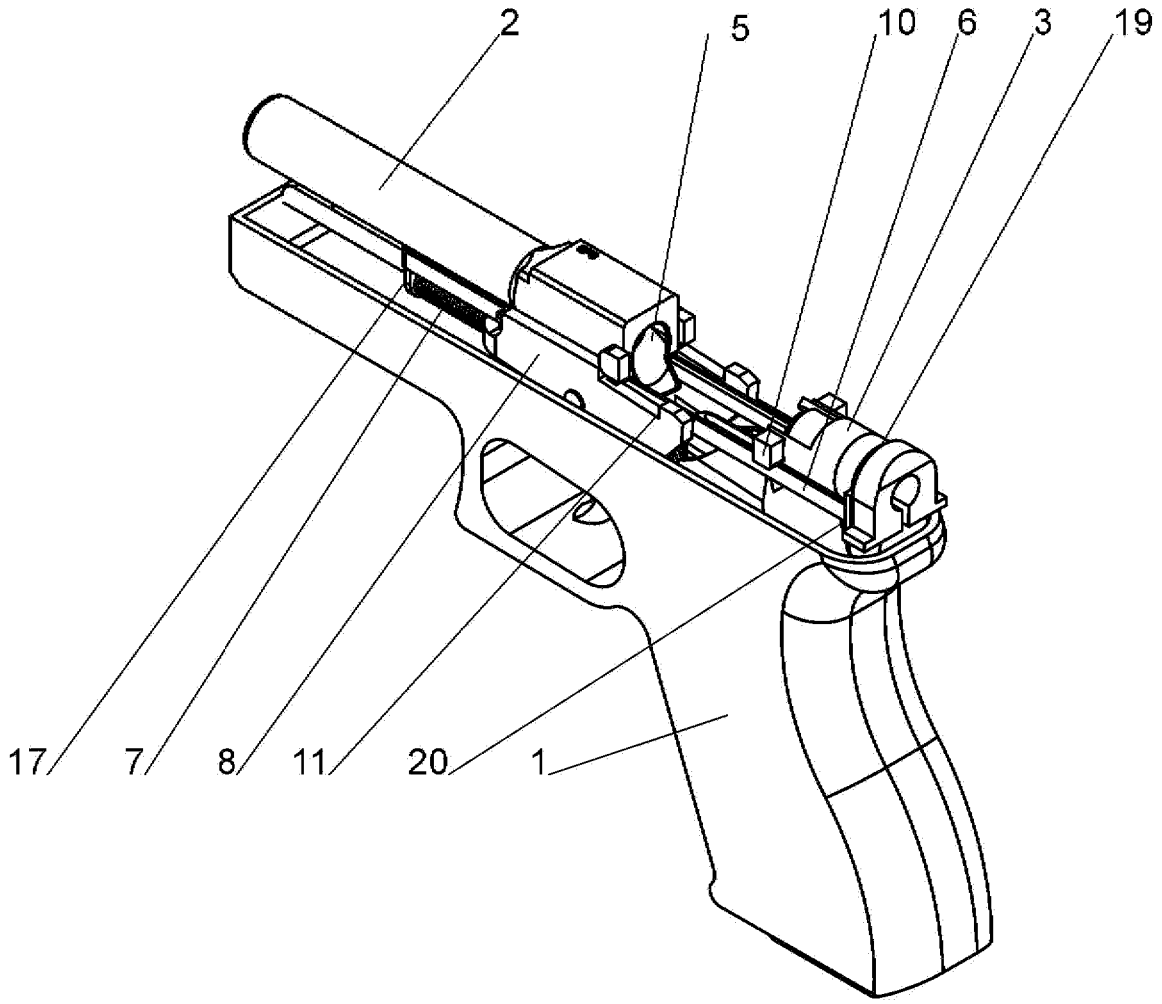
FIG. 7 is another schematic perspective view of a handgun with the receiver removed only on the upper side.

FIG. 7 shows another perspective view of one possible handgun with a latch system therein. Only the upper receiver cover has been removed for the sake of better visibility. In this illustration, the slide 3 is in the rear end position according to FIG. 6. It can be clearly seen that the entire action can be easily accommodated inside the receiver 1, thus enabling the receiver 1 to have a largely closed design without external moving parts, which is why the firearm according to the invention has a particularly low susceptibility to malfunctions and contamination. Due to the small number of moving parts in the action, the firearm according to the invention has a low susceptibility to malfunctions and, due to the rigidly mounted barrel, a high level of accuracy.

The invention claimed is:

1. A firearm comprising:

a receiver;

a barrel;

a slide movable relative to the receiver in a longitudinal direction of the barrel in order to transfer cartridges from a magazine into a chamber in the barrel and to move cartridge casings from the chamber to an ejection port, the slide being supported inside the receiver over its entire movement path;

a drive clip supported inside the receiver and coupled with the slide;

a recoil spring biasing the drive clip toward a front closed position;

a latch block supported inside the receiver and coupled with the slide when the slide is in the front closed position;

bearing pins extending normal to the longitudinal direction of the barrel from the latch block toward the slide or from the slide toward the latch block;

respective guide tracks on the slide or on the latch block and in which the pins are guided, each of the guide tracks having a rear end portion that deviates from the direction of movement of the slide at an angle so as to move the latch block into a position decoupled from the slide upon entry of the bearing pins into these rear end portions; and a latch spring biasing the latch block longitudinally forward such that, upon firing of a shot under compression of the latch spring, the latch block is displaced together with and by the slide only for a portion of the movement path of the slide until the position decoupled from the slide is reached.

2. The firearm according to claim 1, wherein the latch spring has a greater spring constant than the recoil spring.

3. The firearm according to claim 1, wherein the slide has lateral projections that extend normal to a longitudinal direction of movement and engage with respective stop faces on the latch block on movement from the front closed position to the decoupled position, and vice versa.

4. The firearm according to claim 1, wherein the drive clip has securing projections that, upon reaching the decoupled position, engage in corresponding recesses in the latch block during rearward movement of the slide after a shot is fired and secure the latch block during further rearward movement of the drive clip in the decoupled position.

5. The firearm according to claim 1, wherein the recoil spring is supported between a bearing portion of the drive clip and a bearing portion of the latch block.

* * * * *